United States Patent [19]

Lee

[11] Patent Number: 4,693,162

[45] Date of Patent: Sep. 15, 1987

[54] WIND-BELL

[76] Inventor: Cheng F. Lee, 25, Chang-City, Taipei, Taiwan

[21] Appl. No.: 921,744

[22] Filed: Oct. 22, 1986

[51] Int. Cl.[4] ..... G10D 13/08

[52] U.S. Cl. ..... 84/404; D11/141; 446/213; 84/94 C

[58] Field of Search ..... 84/404, 406, 402, 94, 84/94 C, 95, 95 C; 116/141, 169; D11/141; D17/22; 446/213, 217

[56] References Cited

U.S. PATENT DOCUMENTS 2,495,365 1/1950 Cohn ..... 84/94 C
2,828,963 4/1958 Steiner ..... D11/141 X

FOREIGN PATENT DOCUMENTS 127013 1/1947 Australia ..... 446/217

*Primary Examiner*—L. T. Hix
*Assistant Examiner*—Brian Brown
*Attorney, Agent, or Firm*—Ladas & Parry

[57] ABSTRACT

The present invention relates to an improved wind-bell of the seated type comprising of at least two or more blades, a central rotating axle, a striking bar, sound-producing bars, dragging means, a frame and a base plate. The blades are connected to the central rotating axle which is inserted through a bore at the center of the frame into a hollow stationary post secured to the base plate. A plurality of sound-producing bars are provided with hooks on both ends thereof, with hooks on the upper ends hooking at an annular support and hooks on the lower ends hooking at retaining rings provided on the base plate. The striking bar is mounted at a suitable location on the central rotating axle. In use, wind force drives the blades to rotate which, in turn, rotates the central rotating axle, making the striking bar provided thereon rotate with it, thereby striking the sound-producing bars to produce tuneful music sounds. Dragging means is provided in the hollow stationary post, such that the rate of rotation of the blades is regulated by the frictional drag generated between a friction block on the top end of the dragging means and the bottom end of the central rotating axle, and thereby the striking bar is prevented from producing noisy sounds when the wind is too strong.

6 Claims, 3 Drawing Figures

WIND-BELL

BACKGROUND OF THE INVENTION

Republic of China Patent Application No. 75201969, entitled "Innovative Wind-Bell", also filed by the Applicant, has been allowed as notified on Aug. 25, 1986 by the National Bureau of Standards, (but was not yet published when the present application was filed). The present invention is an improvement of the above wind bell.

(1) Field of the Invention

The present invention relates to a wind-bell of the seated type and, in particular, relates to an improved wind-bell characterized in that it is seated on a surface instead of depended from something.

(2) Description of Prior Art

Conventional wind-bells are varied in design and style. Conventional wind-bells comprising essentially of wire-connected sound-producing elements which are depended from the eaves or other wind blown high places. The elements strike each other to make sounds when blown by the wind. However, when these conventional wind-bells are blown by the wind, wires connecting the sound-producing elements will become tangled with each other, resulting in bad appearance of the wind-bells, and even making the elements soundless. Also, the sound-producing elements tend to be damaged due to the elements striking each other too frequently and forcifully when the wind is considerably strong. Furthermore, since it is unable to control the striking of the elements, untuneful noisy sounds, therefore, may occure.

SUMMARY OF THE INVENTION

A wind-bell of the seated type according to the present invention comprises of at least two or more blades, a central rotating axle, a striking bar, a plurality of sound-producing bars, dragging means, a frame and base plate. The blades are connected to the central rotating axle which is inserted through a bore at the center of the frame into a hollow stationary post secured to the base plate. The sound-producing bars are provided with hooks on both ends thereof, with hooks on the upper ends hooking at an annular support and hooks on the lower ends hooking at retaining rings provided on the base plate. The striking bar is mounted at a suitable location on the central rotating axle. In use, wind force drives the blades to rotate which, in turn, rotate the central rotating axle, making the striking bar provided thereon rotate with it, and thereby strike sound-producing bars to produce tuneful music sounds. Dragging means is provided in the hollow stationary post, such that the rate of rotation of the blades is regulated by the frictional drag generated between a friction block on the top end of the dragging means and the bottom end of the central rotating axle, and thereby the striking bar is prevented from producing noisy sounds when the wind is too strong.

One of the objects of the present invention is to provide an improved wind-bell of the seated type which is distinct from the conventional wind-bells in that the wind-bell, according to the present invention, which can be placed in the yard, corridor, or other suitable places where they can be seated, not only produces tuneful music sounds but serves as an enjoyable decorative item.

Another object of the present invention is to provide an improved wind-bell of the seated type wherein the sound-producing bars can be moved to produce regulated, rhythmic music sounds by varying the length of the bars or the material from which the bars are made.

Another objects of the present invention is to provide an improved wind-bell in which the rhythm of the music sounds may be controlled by dragging means, such that no noisy sounds will be produced under strong wind.

Still another object of the present invention is to provide a miniature desk-seated decorative wind-bell which, for amusing purpose, can be made to produce enjoyable music sounds by rotating the blades with a push by a finger or a blow from the mouth.

From the following embodiment and illustrative description in conjunction with the accompanying drawings, other objects, advantages, and features will become apparent to those skilled in the art.

BRIEF DESCRIPTION OF THE DRAWINGS

The present invention will now be described hereinafter with reference to the drawings in which like reference numbers indicate like elements.

DETAILED DESCRIPTION OF THE INVENTION

Figure 1:
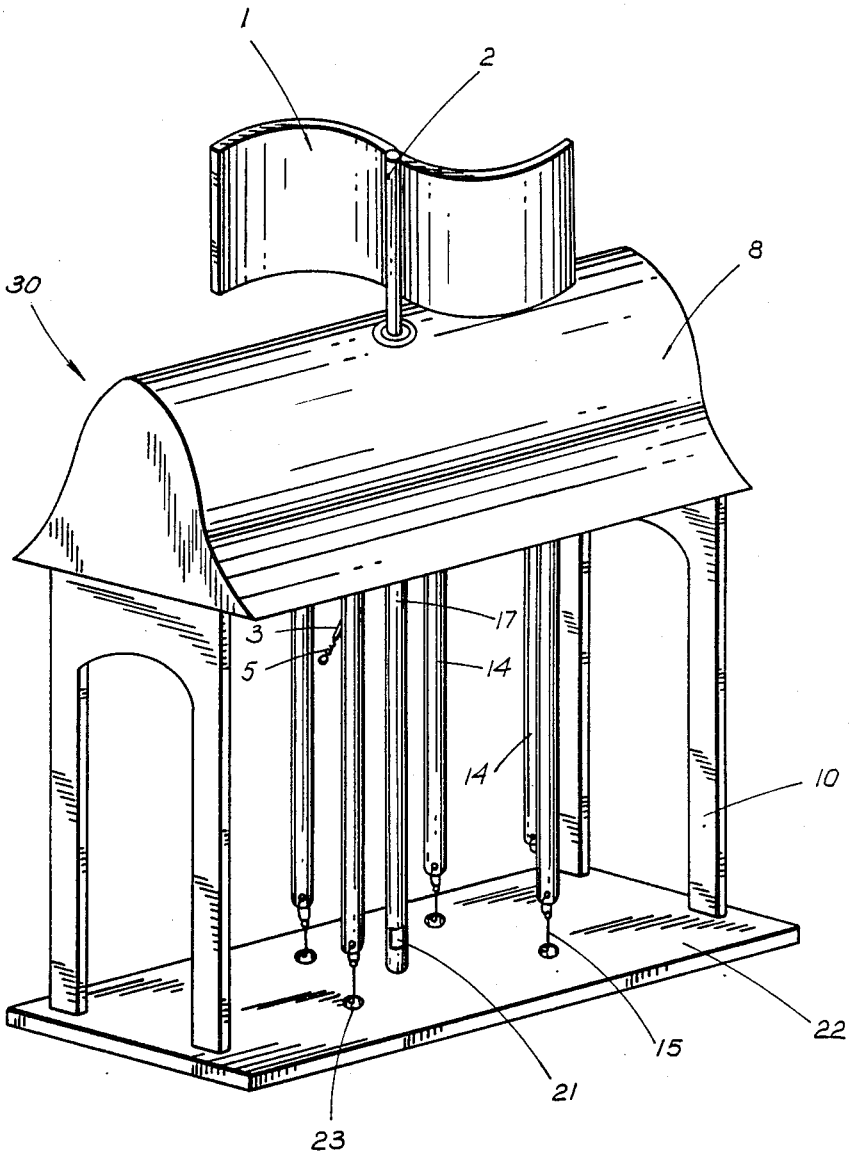
FIG. 1 is a perspective view showing a wind-bell of the seated type according to the present invention.

Referring to the drawings, a wind-bell 30 of the seated type as shown in FIG. 1 is but one example of the present invention, that is to say, the configuration of the frame 8 with its associated legs 10 and base plate 22 is not necessarily in the shape of a lengthwise structure, they can be in the shape of a sphere, a polygon, and the like. The shape which can be varied as desired is independent of other parts of the main structure. The wind-bell shown in FIG. 1 is completely assembled.

Figure 2:
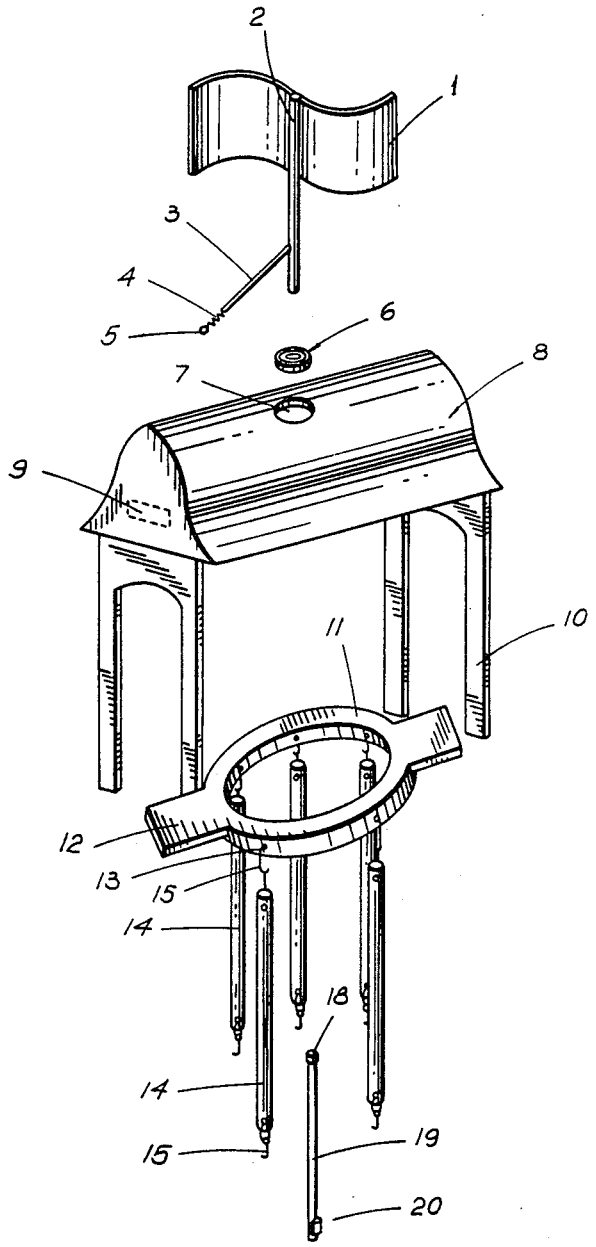
FIG. 2 is an exploded view of the wind-bell shown in FIG. 1.
Figure 2:
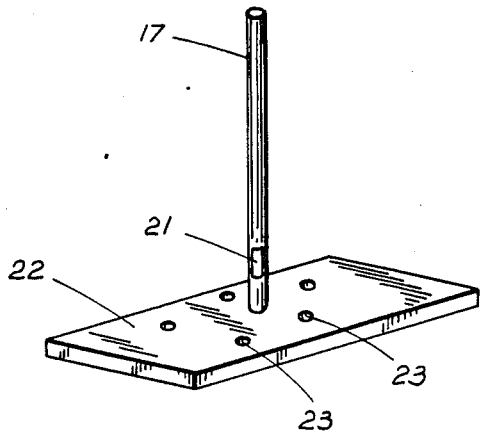
Figure 3:
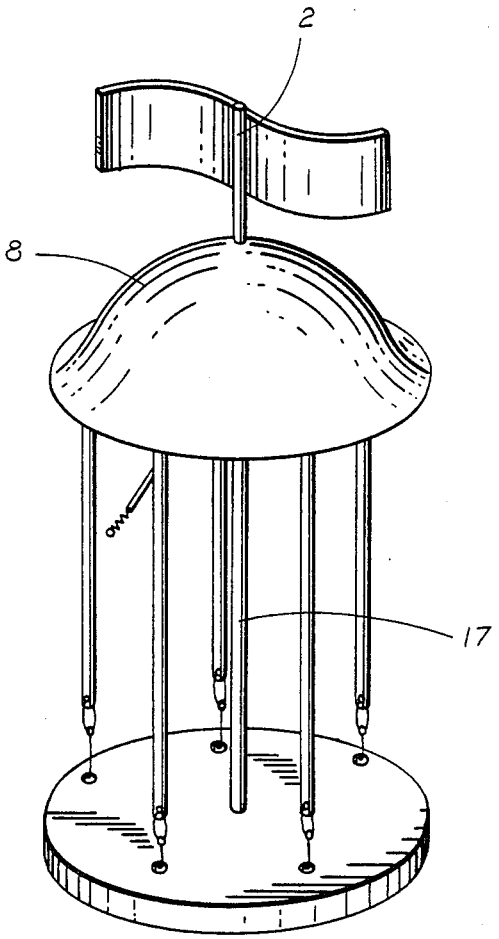
FIG. 3 is a perspective view of a miniature windbell in another embodiment of the present invention.

FIG. 2 is an exploded view showing the structure of the wind-bell of the present invention. As can be seen in FIG. 2, two or more blades 1 are fixedly connected to a central rotating axle 2. The axle 2 is rotatably connected with a ball bearing 6 provided at the center of the frame by being inserted therethrough. Then, the axle 2 is inserted into the hollow stationary post 17 which is secured to the base plate 22. Rotating axle 2 and stationary post 17 together form a vertical axis. The striking bar 3 is threadedly mounted at a suitable location on the central rotating axle 2. The striking bar 3 is formed of a flexible material, the end portion 5 thereof is a striking head which is made to be adequately elastic by being connected to the striking bar 3 with a coil spring 4. The length from the bar 3 to the head 5 equals approximately the radius of the circle within which the sound-producing bars 14 are disposed, such that the striking bar 5 is enabled to strike the sound-producing bars 14. The sound-producing bars 14 are provided with hooks on both ends thereof, with upper hooks hooking at the holes or retaining rings 13 provided on the annular support 11 and lower hooks hooking at retaining rings 23 provided on the surface of the base plate 22. Annular support 11 is connected to the frame at a suitable location internally of the top thereof in a conventional manner, such as by attaching both protruded ends 12 of the annular support to both ends 9 of the frame. The center of the annular support 11 should coincide with the vertical axis of the central rotating axle 2 and the stationary post 17. The post 17 is provided with dragging means 19 within the hollow portion thereof. A pad 18 capable of producing frictional drag, such as a piece of rubber, is provided on the upper end of the means 19 while a regulating block 20 is positioned on the lower end in a hole 21. Moving the regulating block 20 upward will urge the pad 18 against the lower end of the central rotating axle 2, thereby producing dragging force to reduce the rotating rate of the blades. The legs 10 are fixed to the base plate 22, respectively, in a conventional manner.

In use, the wind blows the blades 1 to rotate, causing the rotating axle 2 to rotate with it, thereby moving the striking bar 3 so that the striking head 5 thereof will strike the sound-producing bars 14 to produce tuneful sounds. When the wind is weak, the drag regulating block 20 can be moved downward to be in complete disengagement with the lower end of the central rotating axle 2 to increase the rotating rate of the blades 1. Conversely, when the wind is too strong, the regulating block 20 is moved upward such that the pad 18 applies pressure against the lower end of the rotating axle 2 to produce a frictional drag which reduces the rotating rate thereby to avoid producing noisy sounds.

In another embodiment of the present invention, there is provided a miniature decorative wind-bell which can be seated on a desk, in which, no ball bearing is provided between the central rotating axle 2 and the top end of the frame 8, the central rotating axle 2 is directly inserted into the hollow stationary post 17 and no dragging means 19 in provided therein. The blades are caused to rotate with a blow from the mouth or a push by a finger, so that the wind-bell may be placed on the desk for playing with.

To those skilled in the art, the present invention may include other varied forms within the scope of the spirit thereof and of the claims.

I claim:

1. An improved wind-bell comprising of a plurality of blades, a central rotating axle, a striking bar, a plurality of sound-producing bars, a hollow stationary post, dragging means, a frame, an annular support and base plate, characterized in that the blades are fixedly connected to the central rotating axle, said axle being rotatably connected with a ball bearing provided on the top of the frame by being inserted therethrough or otherwise rotatably connected, said axle being further inserted into the hollow stationary post to form a vertical axis, said stationary post being secured to the base plate to which said frame is fixedly connected; said annular support is fixed to the top portion of said frame, and that the center of said annular support coincides with the vertical axis of said central rotating axle and said stationary post.

2. The wind-bell according to claim 1, wherein the number, length and the material of sound-producing bars may be varied as desired such that different tunes and rhythms may be obtained.

3. The wind-bell according to claim 1, wherein said sound-producing bars are connected to said annular support and base plate with hooks or other detachable means so that replacement of the elements is facilitated.

4. The wind-bell according to claim 1, wherein said dragging means is positioned on the lower portion within said hollow stationary post, on the top end thereof being provided with a friction dragging pad which is in contact with the lower end of said central rotating axle, a regulating block being provided on the exterior side of the lower portion, said dragging means being allowed to move up or down.

5. The wind-bell according to claim 1, wherein said striking bar is provided at a suitable portion on the central rotation axle with a striking head and a coil spring, the length of said striking bar being adequate for said bar to strike sound-producing bars.

6. The wind-bell according to claim 1, wherein said central rotating axle is directly inserted into said hollow stationary post through said top portion of said frame and wherein no dragging means is provided within said stationary post, so that said blades are permitted to rotate freely.

* * * * *